United States Patent [19]

Gana et al.

[11] 4,279,140

[45] Jul. 21, 1981

[54] MILL ROLL BALANCE SYSTEM

[75] Inventors: John Gana, Buckingham Township, Bucks County, Pa.; Dwight L. Torlay, Lawrenceville Township, Mercer County, N.J.

[73] Assignee: United States Steel Corporation, Pittsburgh, Pa.

[21] Appl. No.: 86,003

[22] Filed: Oct. 17, 1979

[51] Int. Cl.[3] ..... B21B 31/04

[52] U.S. Cl. ..... 72/237; 72/238

[58] Field of Search ..... 72/237, 248, 205, 238, 72/239

[56] References Cited

U.S. PATENT DOCUMENTS

| | | | |
|---|---|---|---|
| Re. 18,724 | 1/1933 | George | 72/238 |
| 993,730 | 5/1911 | Stevens | 72/239 |

*Primary Examiner*—Milton S. Mehr

*Attorney, Agent, or Firm*—John F. Carney

[57] ABSTRACT

A mill roll balance system for incorporation within a rolling mill is provided. The balance system includes a rigid beam assembly for guiding a portion of the mechanism utilized to stabilize the top roll and for preventing any resultant horizontal forces due to an unbalanced counterweight apparatus utilized to provide an upward force to the upper roll in the mill. A plurality of steel-yard rods are provided and are continuous in their length from a point below the bottom of the roll housing through the housing to their upper terminus switches proximate the upper roll for providing the necessary counter-balancing upward force to the screw-down mechanism's downward force on the upper roll.

12 Claims, 8 Drawing Figures

MILL ROLL BALANCE SYSTEM

BACKGROUND OF THE INVENTION

Rolling mills are basically formed of at least two vertically displaced rolls positioned within a relatively large housing for containing the roll at their ends. In general, the lower roll is stationary within the housing, while the upper roll is vertically displaceable both toward and away from the lower roll so as to provide for a variable gap between the rolls, thereby producing a product to desired dimensions. Movement of the upper roll is affected through its chock supports through either hydraulic means or a screw-down mechanism operable to bias and move the upper roll toward the lower roll. The forces necessary to move the upper roll downward toward the lower roll and retain the same during the rolling process are enormous in size. Moreover, the forces necessary to counteract the large downwardly directed upper roll forces in order to keep the upper roll in a given position for any period of rolling time are also relatively large and are effected through the use of steelyard rods and support mechanisms to be described below.

The support structure for the upper roll includes steelyard rods which pass from below the housing structure upwardly to engagement with a portion of the chock on either side of the roll. Positioned below the housing and acting as a terminus for each of the steelyard rods is a separator assembly which extends from one set of steelyard rods across to the other set. The separator acts as a rigid support mechanism for the four steelyard rods and as a linkage mechanism for two large counterweight balances positioned below the roll mill housing. The counterweights act through the separator assembly and the steelyard rods to provide an upward counter-balancing force against the downward force upon the upper roll to retain the upper roll in a given desired position. The counterweights are unbalanced due to the fact that there is provided a drive side for the rolls as well as a non-drive side. The drive side incorporates the drive spindles and, accordingly, the counterweight on the drive side of the rolls is either heavier or has a larger moment arm than the non-drive or operator side of the rolls. This unbalanced counterweight situation results in a varying horizontal thrust through the separator assembly as the separator assembly is moved from its low position to its upper position corresponding to the lower position of the roll (its closed position) and the fully open position of the rolls. This horizontal thrust may vary excessively so that there is a resultant horizontal thrust of between ±5,000 to 8,000 pounds in either direction. It is obvious that this resultant horizontal thrust will cause undesireable stresses and forces to the mill housing, to the steelyard rods, the separator, and ultimately, affect the rolling power of the two vertically displaced rolls themselves.

The horizontal thrust noted above also causes undesirable wear in the mill housing holes through which the steelyard rods are passed in their extension from below the mill housing to the roll chock of the upper roll. Due to the horizontal loading of the roll balance system noted above, the steelyard rods wear out in the cast hole of the housing and cause an interference problem inasmuch as they are two piece sections. This interference problem causes the steelyard rods to wear out and necessitates their replacement or may cause a jamming effect which may cause the mill housing to fracture thereby resulting in mill down time.

SUMMARY OF THE INVENTION

The present invention is addressed to a roll mill balance system for a rolling mill of the type having a housing and two vertically displaced rolls which are driven from one side thereof and which incorporate counterbalancing but unequal counterweights. The mill roll balance system incorporates a plurality of continuous steelyard rods connected between a mill separator and the upper roll of the rolling mill. Positioned proximate the separator is a rigid beam assembly for both guiding and supporting the separator normally subject to severe horizontal thrust forces. The rigid beam assembly guides the separator in a substantially vertical direction alone while normalizing the horizontal thrust directed to the separator by the unbalanced counterweight loads. The one-piece steelyard rods are self-supporting and require no mill housing guidehole. Their construction and configuration prevents interference of the previous two-piece steelyard rods within the mill housing and the possibility of the two pieces jamming and causing the mill housing to break.

The rigid beam assembly of the present invention is designed to fit at the bottom of the mill for rigidity and to the separator for guide movement and substantially prevent movement of the separator and associated hardware in either of the horizontal directions due to the horizontal thrust previously discussed. The total roll balance assembly alleviates the problem of breakage and provides for a horizontal thrust which is contained and which results in a zero center travel deviation for the separator and associated mechanisms.

Accordingly, it is a general object and feature of the present invention to provide a mill roll balance system for negating the possible breakage of the mill and for preventing the horizontal thrust from the mill counterbalance weights from causing horizontal movement to the guide mechanisms of the mill itself.

Another object and feature of the present invention is to provide a steelyard rod which extends continuously from a point below the bottom of the housing through the housing and terminating in its upper extent in a supportive relationship with the rolling mill's upper roll.

It is another object and feature of the present invention to provide a rigid beam assembly for a rolling mill separator assembly for both guiding the separator assembly in a substantially vertical direction as well as counteracting any resultant horizontal forces upon the separator assembly due to the unbalanced forces resulting from the unbalanced counterweight loads included within the rolling mill.

Other objects and features of the present invention will, in part, be obvious and will, in part, become apparent as the following description proceeds. The features of novelty which characterize the invention will be pointed out with particularity in the claims, annexed to and forming part of the specification.

BRIEF DESCRIPTION OF THE DRAWINGS

The novel features which are considered characteristic of the invention are set forth with particularity in the appended claims. The invention itself, however, both as to its structure as well as its operation together with the additional objects and advantages thereof, will best be understood from the following description of the preferred embodiment of the present invention when read in conjunction with the accompanying drawings wherein:

DETAILED DESCRIPTION OF THE DRAWINGS

Figure 1:
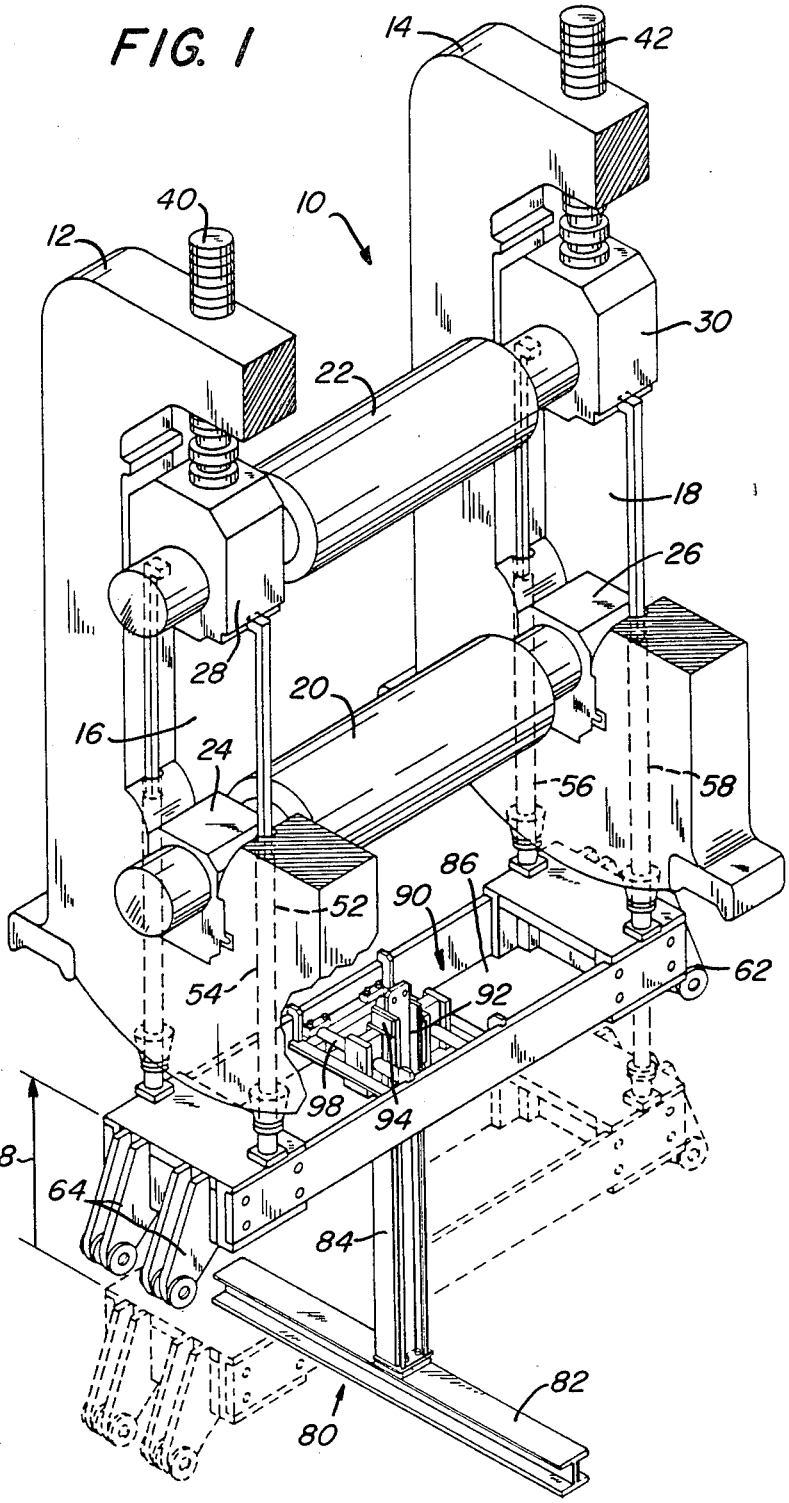
FIG. 1 is a perspective view of a rolling mill incorporating the features of the present invention and showing movement of portions of the elements contained therein for illustrating the functions of the present invention.
Figure 2:
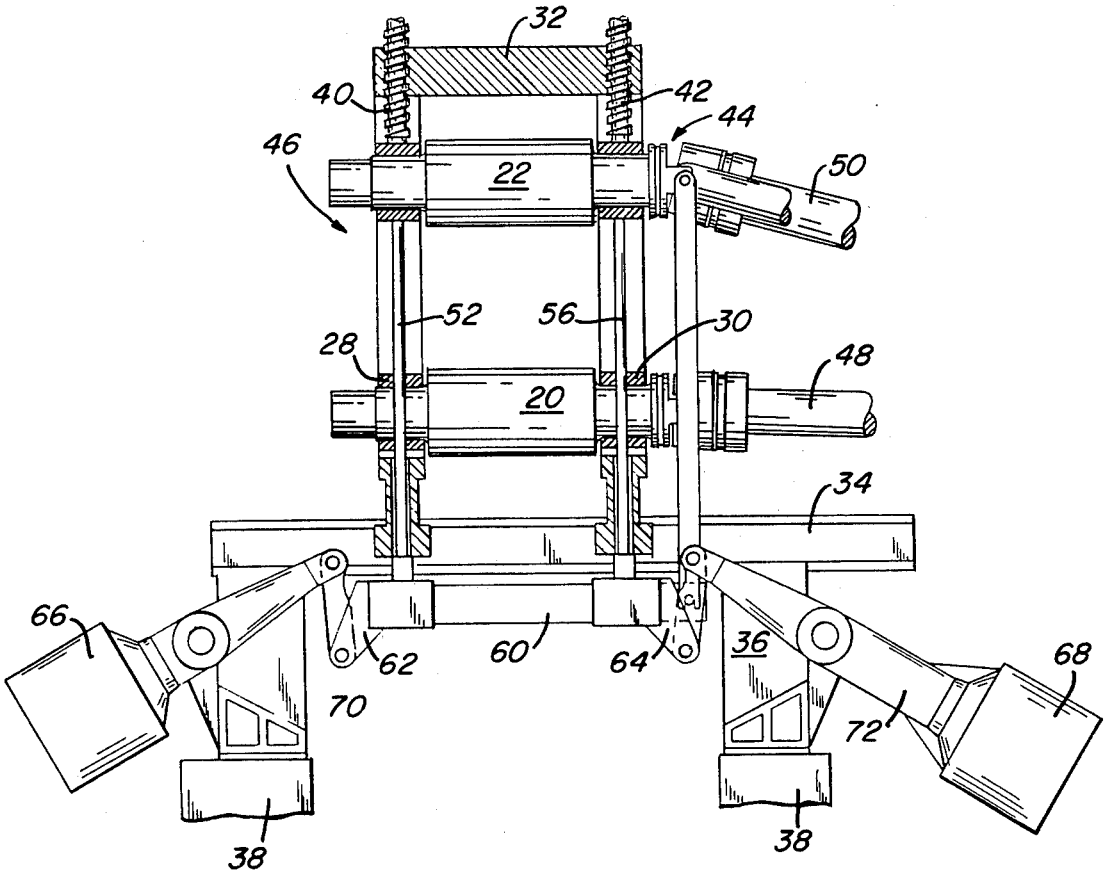
FIG. 2 is an end elevational view of the rolling mill of FIG. 1 incorporating additional elements and showing the rolls in an open position.
Figure 3:
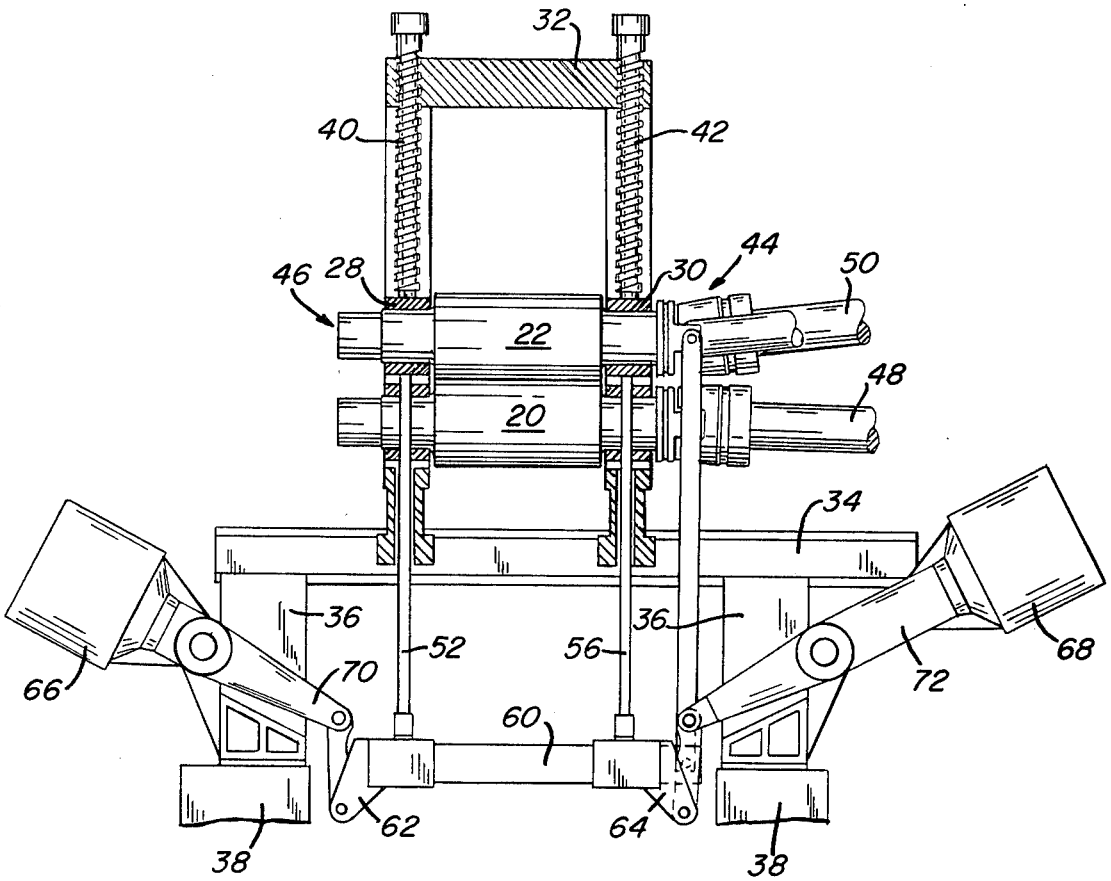
FIG. 3 is an end elevational view of the mill of FIG. 2 with the rolls shown in their closed position.

Looking to FIGS. 1, 2 and 3 there is shown a conventional type rolling mill 10. The rolling mill 10 generally includes two large housing sections 12 and 14 which are partially broken away in FIG. 1 to reveal internal detail. The housing members 12 and 14 are generally oblong in configuration and have central cut-out portions 16 and 18 provided therein, respectively. Provided within the cut-out portions 16 and 18 and extending between the two housings are work rolls 20 and 22. The upper work roll 22 and the lower work roll 20 are configured parallel to one another for establishing a variable product gap therebetween during the rolling operation of the mill. Lower work roll 20 is statically positioned within the bottom portion of the housings 12 and 14 through chocks 24 and 26, while the upper work roll 22 has associated with it chocks 28 and 30. All of the previous mentioned chocks support the work rolls for rotation during the rolling operation of the mill. The lower work roll 20 is stationary while the upper work roll 22 is movable in a vertical direction with respect to the lower work roll 20 as will be explained below.

The two housings 12 and 14 are joined at their uppermost portions by a support beam 32 evidenced in FIGS. 2 and 3. The support beam 32 provides a stabilizing effect to the upper portions of the mill housing assembly. Structural support for the lower portion of the housings 12 and 14 is provided through a beam assembly 34 as shown in FIGS. 2 and 3. The support structure 34 is ultimately tied into the environment upon which the mill housing rests through appropriate structure as at 36 and 38.

Vertical movement of the upper work roll 22 both toward and away from the lower roll 20 may be effected by any convenient drive mechanism currently used in the art. For illustrative purposes, this drive system in the present invention is shown as a screwdown mechanism and includes large screwdown shafts 40 and 42 which pass through the top portions of the housings 12 and 14 and are connected to the upper roll chocks 28 and 30 as shown in FIG. 1. The screw-down mechanism, through the shaft 40 and 42 provide the necessary large forces for biasing the upper roll toward the lower roll against the likewise large forces applied to the rolls by the workpiece being rolled during the rolling operation. While screw-down mechanisms have been shown, it should be appreciated that any commonly available force mechanism may be employed such as hydraulics and the like.

As indicated in FIGS. 2 and 3, the rolling mill 10 is constructed having a drive side 44 and an operator side 46. Rotational driving of the two rolls 20 and 22 is effected through drive shafts 48 and 50, respectively. The drive shafts 48 and 50 are independently associated with each of the rolls 20 and 22, respectively, as may be evidenced in a comparison of their positions relative to one another in FIGS. 2 and 3. The shafts 48 and 50 are connected to their respective rolls by conventional means which need no further description here. It should be noted, however, that the drive side of the rolling mill is heavier than the operator side due to the relatively large masses of the drive shaft 48 and 50. This unbalanced weight distribution will be discussed in further detail below as it relates specifically to one portion of the present invention.

As previously noted, upper roll 22 is moved both toward and away from the lower roll 20 through the use of the screw shafts 40 and 42. In order to provide for the easy movability of upper roll 22 both toward and away from lower roll 20, there is provided in conventional rolling mills a counteracting top roll balance system which is provided for the purpose of keeping the top roll chocks up tight against the screw down mechanisms, the roll necks themselves in contact with the upper bearings of the chock and the screw thread surfaces in contact. The top roll balance system additionally provides for the easier movement of the top roll upwardly away from the bottom roll 20 in those circumstances in which the gap between the two rolls is desirably increased. The top roll balance system generally includes steelyard rods 52, 54, 56 and 58 as indicated in FIGS. 1–3. The specific construction of the steelyard rods will be discussed below. The steelyard rods extend from the upper roll chocks 28 and 30 downwardly through holes provided within the bottom portion of the housings 12 and 14 and extend through the lower portion of the housing terminating upon a separator 60.

The separator 60 extends from one housing toward the other across the full width of the housings and the rolling mill itself. This may be best seen by referring to FIGS. 1, 2 and 3. The separator 60 provides a terminus for the steelyard rods 52, 54, 56 and 58 and is the assemblage through which the counterweight forces are effected to the steelyard rods and in turn to the upper roll 22 through its chocks 28 and 30. Provided at each end of the separator assembly 60 are linkage arms 62 and 64 (see FIG. 1). The linkage arms 62 and 64 are in turn connected to appropriate additional linkages and pins to massive counter-balance weights 66 and 68 as shown in FIGS. 2 and 3. The counter-balance weights 66 and 68 provide the necessary forces to retain the separator assembly 60 and the steelyard rods 52, 54, 56 and 58 in an upwardly biased attitude into contact with the roll chocks 28 and 30 for the upper roll 22. It should be noted that the counterweights 66 and 68 do not provide the same upward forces to their respective sides of the rolling mill 10. This unbalanced roll balancing system may be accomplished either by different sized weights having the same moment arm, or alternatively, the same sized counter-balance weights with different moment arms. In the preferred embodiment of the invention it can be seen that the counterweight 66 is provided with a moment arm 70 of shorter length than the moment arm 72 associated with counter-balance weight 68, thereby providing a greater upward force to the drive side of the mill than the operator side due to the additional weight provided by the drive spindles 48 and 50 and appropriate linkages therefor to the drive side of the rolls 20 and 22. The relative positions of the rolls, steelyard rods, separator and counterweights can best be evidenced by comparing the closed position of the rolls in FIG. 3 with the open position in FIG. 2.

Figure 4A:
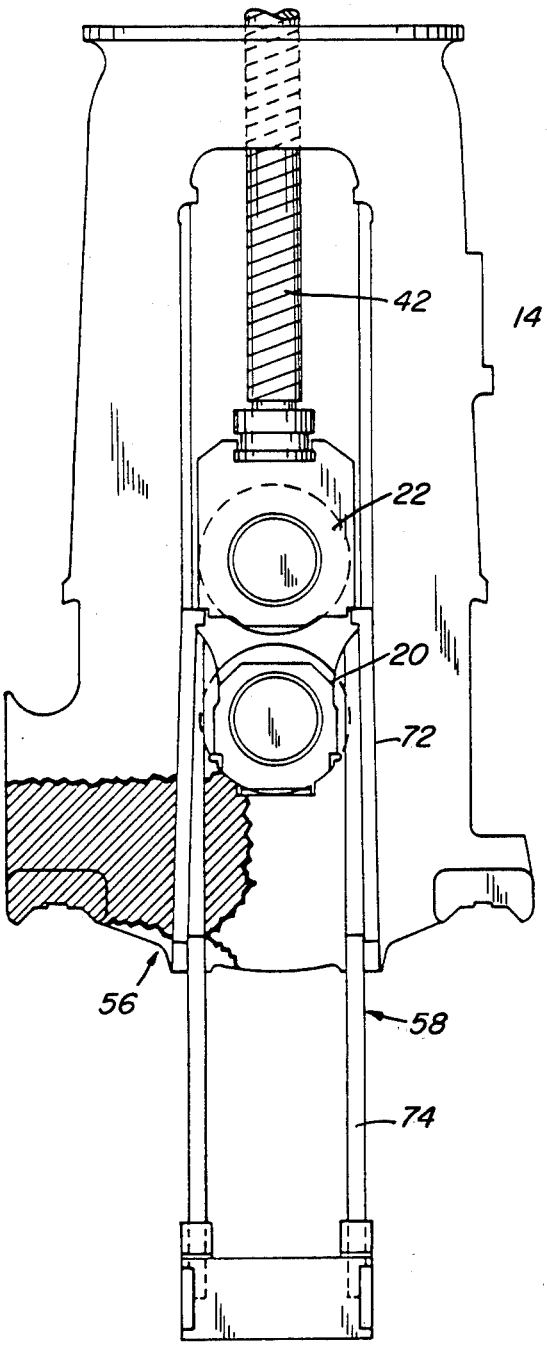
FIG. 4*a.* is a side elevational view of a portion of the rolling mill FIG. 1 indicating problem areas prior to the introduction of the features of the present invention.
Figure 4B:
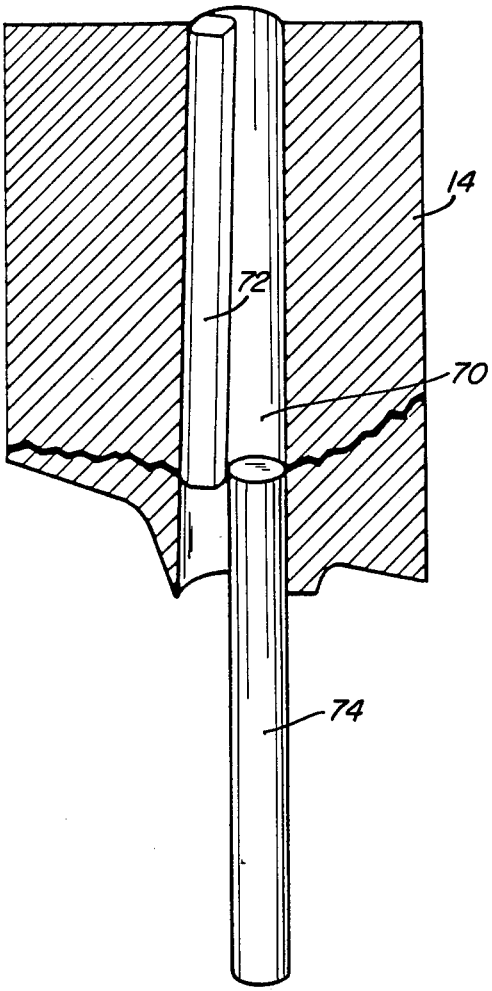
FIG. 4*b.* is a detailed view of a portion of FIG. 4*a.*.
Figure 6:
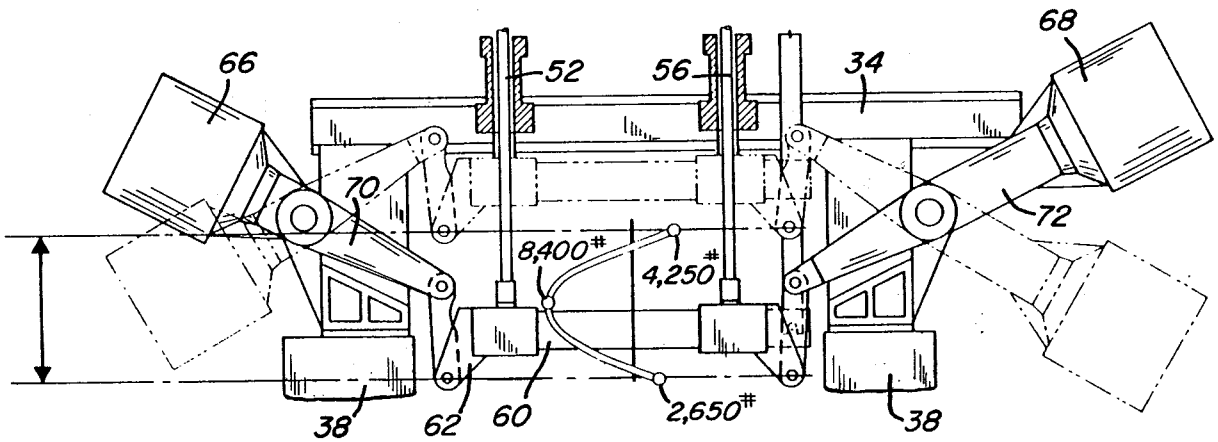
FIG. 6 is an end elevational view of one portion of the rolling mill of FIG. 1 with a graphic overlay in order to show the horizontal thrust forces inherent in a rolling mill.

The unbalanced nature of the roll balancing system described above provides for the equalization or balancing of the forces on the rolls 20 and 22 and especially upper roll 22. However, due to the greater weight or moment arm associated with the counterweight on the drive side of the rolling mill 10, there is produced a horizontal thrust to the separator, steelyard rods and the mill in general which may range over several tons and which has been shown to cause deleterious effects. In this regard reference should be made to FIGS. 6 and 4*a* and 4*b*. As indicated in FIG. 6, through a graphic overlay, the horizontal thrust which is applied to the separator and other previously mentioned elements of the mill ranges from 2650 pounds in one direction at the closed roll position through an 8400 pound thrust in the opposite direction when the mill is half open and back again to a 4250 pound horizontal thrust when the mill is fully open based upon applicant's analysis. Therefore, in the closed position there is a resultant horizontal thrust to the right (as seen in FIG. 6), a 8400 pound horizontal thrust to the left in a half-opened position of the mill and a 4250 pound horizontal thrust again to the right in the fully opened position. While the structure of the elements shown in the mill are of immense size and strength, they are insufficient alone to compensate or normalize the horizontal thrust just previously discussed. One example of how this horizontal thrust range effects the mill itself can be best seen by particular reference to FIGS. 4*a* and 4*b*. The steelyard rods, for example at 56 and 58 (FIG. 4*a*) tend to wear out the mill housing 14 in a bell shape as shown in FIG. 4*b*. While the process of the steelyard rods wearing a bell-shaped hole in the housing may take a considerable amount of time, there is still resultant an expansion of the bore hole 70 to a size which is larger than the combined diameter of the two-piece steelyard rod shown in FIGS. 4*a* and 4*b*. Each of the steelyard rods had previously been composed of an upper octagonal- or hexagonal-shaped bar 72 and a lower circular bar 74 which were not joined together but which acted together in a vertical direction. Due to the massive amounts of horizontal thrust as indicated in FIG. 6, they wore the bell-shaped hole in the housing through constant use and permitted at some point the overlapping of the upper and lower portion of the steelyard rods 72 and 74 into a relationship shown in FIG. 4*b*. Under the normal circumstances these two steelyard rod elements would be in a vertically aligned relationships but for the wearing of the bore hole 70 and its expansion to permit their overlap. Consequently, when these two steelyard rod elements were permitted to overlap, there was presented the distinct possibility of mill fracture as shown in heavy black lines in FIGS. 4*a* and 4*b*. Should this overlapping fracture occur, the mill housing would be irreparably damaged, the mill shut down and precious time and expense spent on replacing the mill housing which was broken.

The situation just described was caused by two factors, i.e., the two-piece steelyard rod configuration as well as the excessive horizontal thrust loads applied to the separator and the steelyard rods due to the unbalanced counter-weight arrangement noted above. It is interesting to note that two-piece steelyard rods have been employed for a considerable amount of time due to the impossibility of extending a single piece steelyard rod through the bore hole 70 from below the mill inasmuch as there was interference with the foundations for the mill itself just below the lower position of the separator as shown in FIG. 6. It was for this reason that two-piece steelyard rods were used. Secondly, the horizontal thrusts which were permitted to act on the separator and steelyard rods cause these two-piece steelyard rods to wear the bell-shaped hole previously discussed and to permit the undesirable overlapping of the two-piece steelyard rods with one another.

In order to compensate for the large ranging horizontal thrusts resultant from the "unbalanced" counterweight system previously discussed the present invention provides for a horizontal thrust normalizing apparatus for rigid beam assembly for the separator 60. The rigid beam assembly for the separator 60 is shown generally in FIG. 1 at 80. Rigid beam assembly 80 generally includes a horizontal support beam member 82 which is statically positioned below the mill through conventional and appropriate means. Extending vertically and upwardly from beam 82 is a vertical beam 84. The beam 84 is positioned through the center of the opening 86 provided within the separator 60 and extends a distance substantially equal to the upward vertical travel distance of the separator 60 as indicated by arrow 88 in FIG. 1. Attached to the separator 60 through any appropriate means such as bolting or welding is a guide rack assembly shown generally at 90 which is configured and positioned in slidable relationship with the beam 84. The guide rack 90 includes two laterally displaced and gimbaled slide plates 92 and 94. The slide plates 92 and 94 are gimbaled along or through gimbal rods 96 and 98. The sliding association between the guide plates 92 and 94 and the vertical beam 84 through the rigid attachment of the guide rack 90 to the separator 60 provides for the stabilization of the separator 60 in a horizontal position thereby normalizing the vastly ranging horizontal thrusts previously discussed which are resultant from the "unbalanced" balancing counterweights. The guide plates 92 and 94 slide along the vertical beam 84 throughout the entire movement of the separator 60 as indicated by arrow 88 in FIG. 1 and are gimbaled in order to provide for any minor misalignment of the vertical beam 84 and/or the slide plates 92 and 94. It can be realized that this relationship between the guide rack 90 which is rigidly attached to the separator 60 and the vertical guide beam 84 provide for the necessary horizontal retention of the separator 60 and steelyard rods 52, 54, 56 and 58 thereby preventing the horizontal thrusts from the counterweights to deleteriously effect any of the previously described elements.

Figure 5A:
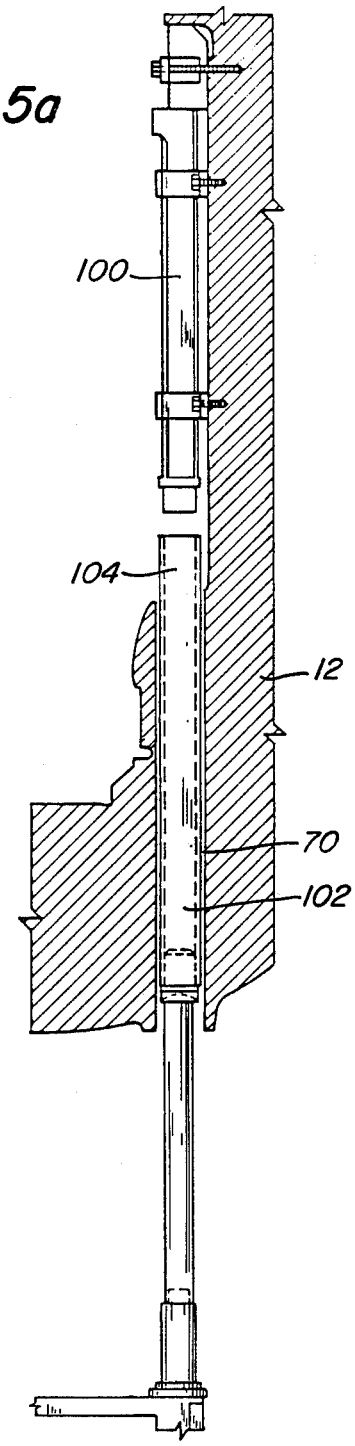
FIGS. 5*a.* and *b.* are elevational views of a portion of the steelyard rods incorporated within the present invention.
Figure 5B:
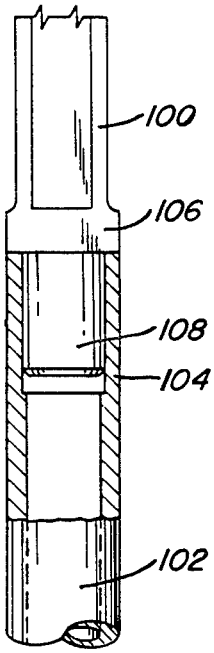

Applicant has additionally provided a configuration for the steelyard rods which would further alleviate any misalignment of the two-piece steelyard rods previously discussed and the belling out of the bore holes 70 provided within the housing 12 and 14 by the steelyard rods. Looking to FIGS. 5*a* and 5*b*, there is provided a continuous "one-piece" steelyard rod which is self-supporting and self-guiding. Additionally, the specific configuration of applicant's steelyard rods permits the joining of two pieces together within the physically confining mill housing configuration so as to form a single piece or continuous steelyard rod from its full upper extent to its full lower extent. Specifically, applicant has provided both a top steelyard rod 100 and a lower or bottom steelyard rod 102 which are joined together to form one continuous steelyard rod. The upper steelyard rod 100 as indicated in FIG. 5*a* is attached to the housing 12 through any conventional and appropriate bolting and clamping arrangement from inside the housing itself and not through the bore hole 70. The lower or bottom steelyard rod 102 is of a length which permits it to be moved into its operable position in spite of the close tolerances located at the bottom of the housing and the mill foundation itself. In particular, the upper steelyard rod 100 is bolted in place as indicated in FIG. 5*a* and the lower or bottom steelyard rod 102 is placed in position just below the housing 12. The lower steelyard rod 102 is then jacked into a position indicated in FIG. 5*a* and its top, 104, is heat treated thereby causing the expansion of the rod 102 in its upper extent. It should be noted that the upper steelyard rod 100 is optimally configured having a solid configuration while the lower steelyard rod takes on a configuration similar to a large diameter thick-walled pipe. This orientation and configuration may best be seen in FIG. 5*b*. When the bottom steelyard rod is located, as indicated in FIG. 5*a*, its top is heat treated for expansion purposes and then it is jacked from below by any appropriate means into abutting relationship with the lower portion 106 of steelyard rod 100. Steelyard rod 100 is configured at its lower extent having an extension 108 which fits into the upper portion 104 of the lower steelyard rod. Due to the prior expansion of the upper portion of steelyard rod 102 the two steelyard rod pieces may be easily fitted together and then held in place until the upper portion 104 of steelyard 102 cools and shrinks around extension 108 of steelyard rod 100. When this shrink fit has been accomplished, the two steelyard rods are joined together and will not be separated under normal operating procedures. The two steelyard rod pieces then form one continuous steelyard rod extending from the chocks for the upper roll 22 to a position in which it terminates on the separator 60. Configured as such, the steelyard example shown in FIG. 5*a* is self-supporting and requires no mill housing guide holes such as previously used in the two-piece steelyard rods previously discussed. It should be noted that the prior use of the two-piece steelyard rod unit was due to a lack of skills required to assemble and press fit the one-piece continuous rod indicated in FIGS. 5*a* and 5*b*. It then becomes apparent that the use of a continuous "one-piece" steelyard rod alleviates the problems associated with the two-piece steelyard rods previously noted and, along with the rigid beam assembly previously discussed, forms the basis for a horizontal thrust normalizing assembly.

In conclusion, it may be seen that there is provided a simple, efficient and inexpensive mill roll balance system for use with a rolling mill having "unbalanced" counterweights. The lack of complicated components and the simplification of the moving parts, as well as the continuous steelyard rod previously noted, provide for a reliable and easily constructed arrangement without the need for cumbersome and expensive components used previously. Moreover, the components incorporated within the present invention do not subject the mill housings to the possibility of fracture or breakage thereby resulting in undesirable down time.

While certain changes may be made in the above-noted apparatus without departing from the scope of the invention herein involved, it is intended that all matter contained in the above description or shown in the accompanying drawings, shall be interpreted and illustrative and not in a limiting sense.

We claim:

1. A mill roll balance system for a rolling mill of the type having a housing and two vertically displaced rolls which are driven from one side thereof and a mechanism for vertically driving the upper roll both toward and away from the lower roll, which is not vertically movable, said mill roll balance system comprising:

steelyard rod means extending from a point below the bottom of the housing through the housing and terminating in its upper extent in a supportive relationship with the upper roll;

separator means located below the housing of the rolling mill, said steelyard rod means and said separator means being movable with said upper roll as the latter is vertically moved, said separator means acting as a terminus for the lower portion of said steelyard rod means;

unbalanced counterweight means connected to said separator means for providing an upward and unbalanced force to the separator means so that the drive side of the rolls has a greater upward force than the non-driven side of the rolls for counteracting the downward forces from the vertical driving mechanism when such mechanism forces such top roll toward such lower roll thereby stabilizing such lower roll at a given desired position; and a rigid beam assembly in supportive relationship with the separator means for guiding the separator means in a substantially vertical direction and counteracting any resultant horizontal forces upon the separator means due to the unbalanced forces resultant from said unbalanced counterweight means.

2. The mill roll balance system according to claim 1 wherein said steelyard rod means are continuous over their full length.

3. The mill roll balance system according to claim 1 wherein said steelyard rod means are continuous over their full length and are formed from at least two separate elements having been joined through a heat treated shrink fit.

4. The mill roll balance system according to claim 1 wherein said steelyard rods are configured to be self-supporting and require no guideholes within such housing.

5. The mill roll balance system according to claim 1 wherein said rigid beam assembly includes a guide beam extending vertically throughout the length of vertical movement of said separator means in rigid attachment to said separator means and which is in engageable association with said guide beam and a guide rack for guiding and supporting said separator means and counteracting any horizontal force upon said separator means resultant from said unbalanced counterweight means.

6. The mill roll balance system according to claim 5 wherein said guide rack includes slide plates which are in slideable engagement with said guide beam.

7. A rolling mill, said rolling mill comprising:

housing means including a supporting structure therefore for supporting said housing means in a desired location;

roll means located in the confines of said housing, said roll means including a vertically movable upper roll and a stationary lower roll;

means for moving said upper roll both toward and away from said stationary lower roll for limiting the size of the product being passed through said rolling mill;

steelyard rod means extending through portions of said housing means and movable through said housing means, said steelyard rod means having its upper end in supportive association with said upper roll and its lower end extending below said housing means, said steelyard rod means being continuous throughout its length and supporting said upper roll against downward forces from said moving means;

separator means located below said housing means and providing a terminus for the lower end of said steelyard rod means, said separator means being movable vertically along with said steelyard rods means and supporting said steelyard rod means;

counterweight means, attached to said separator means, for providing the necessary upward forces to said separator means and said steelyard rod means for counteracting downward forces from said moving means wherein said upper roll is stabilized in a given position; and guide rack means, positioned in guiding associative relationship with said separator means, for guiding said separator means for vertical movement alone as said separator means is move upwardly and downwardly and for negating any resultant horizontal forces from said counterweight means.

8. The rolling mill according to claim 7 wherein said steelyard rod means are continuous over their full length.

9. The rolling mill according to claim 7 wherein said steelyard rod means are continuous over their full length and are formed from at least two separate elements having been joined through a heat treated shrink fit.

10. The rolling mill according to claim 1 wherein said steelyard rods are configured to be self-supporting and require no guideholes within said housing means.

11. The rolling mill according to claim 1 wherein said guide rack means includes a guide beam extending vertically throughout the length of vertical movement of said separator means in rigid attachment to said separator means and which is in engageable association with said guide beam and a guide for guiding and supporting said separator means and counteracting any horizontal force upon said separator means resultant from said unbalanced counterweight means.

12. The rolling mill according to claim 11 wherein said guide includes slide plates which are in slideable engagement with said guide beam.

* * * * *